United States Patent [19]

Schewe

[11] Patent Number: 4,850,086

[45] Date of Patent: Jul. 25, 1989

[54] WARPER WITH IRONING ROLLS

[75] Inventor: Richard A. Schewe, Loves Park, Ill.

[73] Assignee: Reed-Chatwood, Inc., Rockford, Ill.

[21] Appl. No.: 199,813

[22] Filed: May 27, 1988

[51] Int. Cl.[4] ..... D02H 3/00

[52] U.S. Cl. ..... 28/196

[58] Field of Search ..... 28/196, 197; 242/71.9; 226/185

[56] References Cited

U.S. PATENT DOCUMENTS 320,466 6/1885 Dickinson ..... 28/196

581,299 4/1897 McTaggart ..... 28/196

FOREIGN PATENT DOCUMENTS 28322 of 1909 United Kingdom ..... 28/196

*Primary Examiner*—Robert R. Mackey

*Attorney, Agent, or Firm*—Leydig, Voit & Mayer

[57] ABSTRACT

A warper for drawing textile strands from a creel and for winding the strands on a rotatable beam which forms part of the warper. During winding, the strands are pressed against the beam by a pair of parallel ironing rollers. Each ironing roller has a long section ruggedly supported at both ends by bearings and a short section having one end supported by one of the bearings and an unsupported opposite end. The ironing rollers may be adjusted axially to accommodate beams of different lengths. The ironing rollers axially overlap one another in all adjusted positions so as to insure that all threads on each beam are pressed by at least one roller.

7 Claims, 3 Drawing Sheets

WARPER WITH IRONING ROLLS

BACKGROUND OF THE INVENTION

This invention relates generally to a textile machine and, more particularly, to a warper for drawing multiple textile strands from a supply such as a creel and for winding the strands on a rotatable drum or beam. The beam comprises a central mandrel and further comprises a pair of axially spaced end flanges projecting radially outwardly from the ends of the mandrel. It is customary for the warper to be capable of handling beams of different lengths, that is to say, beams having differently spaced end flanges.

In some warpers, a pressor roll or ironing roll is located between the flanges and rotates about an axis extending parallel to the axis of the beam. The ironing roll presses against the threads as they are wound around the beam and helps achieve a pack of uniform density on the beam.

With prior warpers, the ironing roll is rotatably supported by cradle-type bearings. Whenever the warper is changed over to handle a beam of different length, it is necessary to remove the ironing roll from the warper and to install a longer or shorter roll. This is a time-consuming task and, in addition, requires that several rolls of different lengths be made available for use by the warper.

SUMMARY OF THE INVENTION

The general aim of the present invention is to completely eliminate the need for replacing the ironing roll when the warper is changed over to run with beams of different lengths.

A more detailed object of the invention is to achieve the foregoing through the provision of multiple ironing rolls which may be uniquely adjusted in effective length so as to insure that each thread on the beam is contacted by at least one ironing roll regardless of the length of the beam.

Another object of the invention is to provide an ironing roll arrangement in which two ironing rolls may be compactly positioned between the end flanges of a short beam and may be adjusted axially into various degrees of overlapping relation in order to accommodate longer beams.

Still a further object of the invention is to provide uniquely arranged bearings which support the ironing rolls in a rugged manner while permitting the ironing rolls to effectively span substantially the entire distance between the end flanges of the beam.

These and other objects and advantages of the invention will become more apparent from the following detailed description when taken in conjunction with the accompanying drawings.

DETAILED DESCRIPTION OF THE PREFERRED EMBODIMENT

Figure 1:
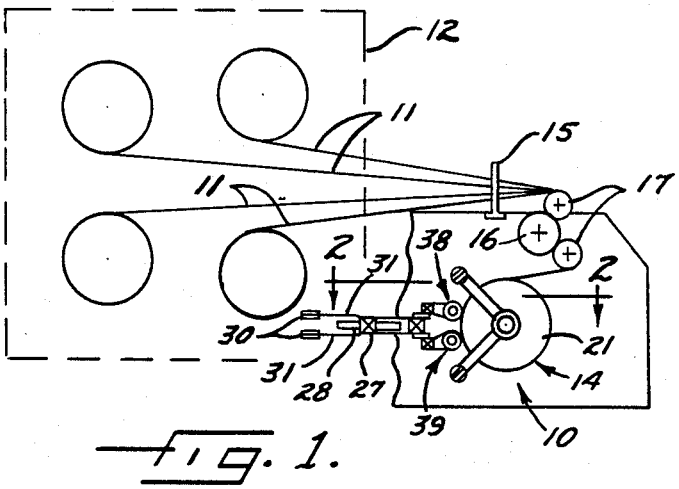
FIG. 1 is a schematic view of a textile machine equipped with new and improved ironing rollers incorporating the unique features of the present invention.

For purposes of illustration, the present invention has been shown in the drawings as being embodied in a textile machine 10 and more particularly in a warper for drawing textile strands 11 from a supply such as a creel 12 and for winding the strands tightly around a large roller or beam 14 which forms part of the warper. As shown schematically in FIG. 1, the beam 14 of the warper 10 is supported to turn about a horizontal axis and is rotated in a conventional manner and in a counterclockwise direction about that axis by a drive motor (not shown). During rotation of the beam 14, multiple strands 11 are drawn from the creel 12, pass through a comb 15 and then are wound tightly around the beam. A power-rotated delivery roll 16 and two nip rolls 17 are located between the creel and the beam and act to isolate the tension in the strands at the beam from the tension in the strands at the creel.

Figure 2:
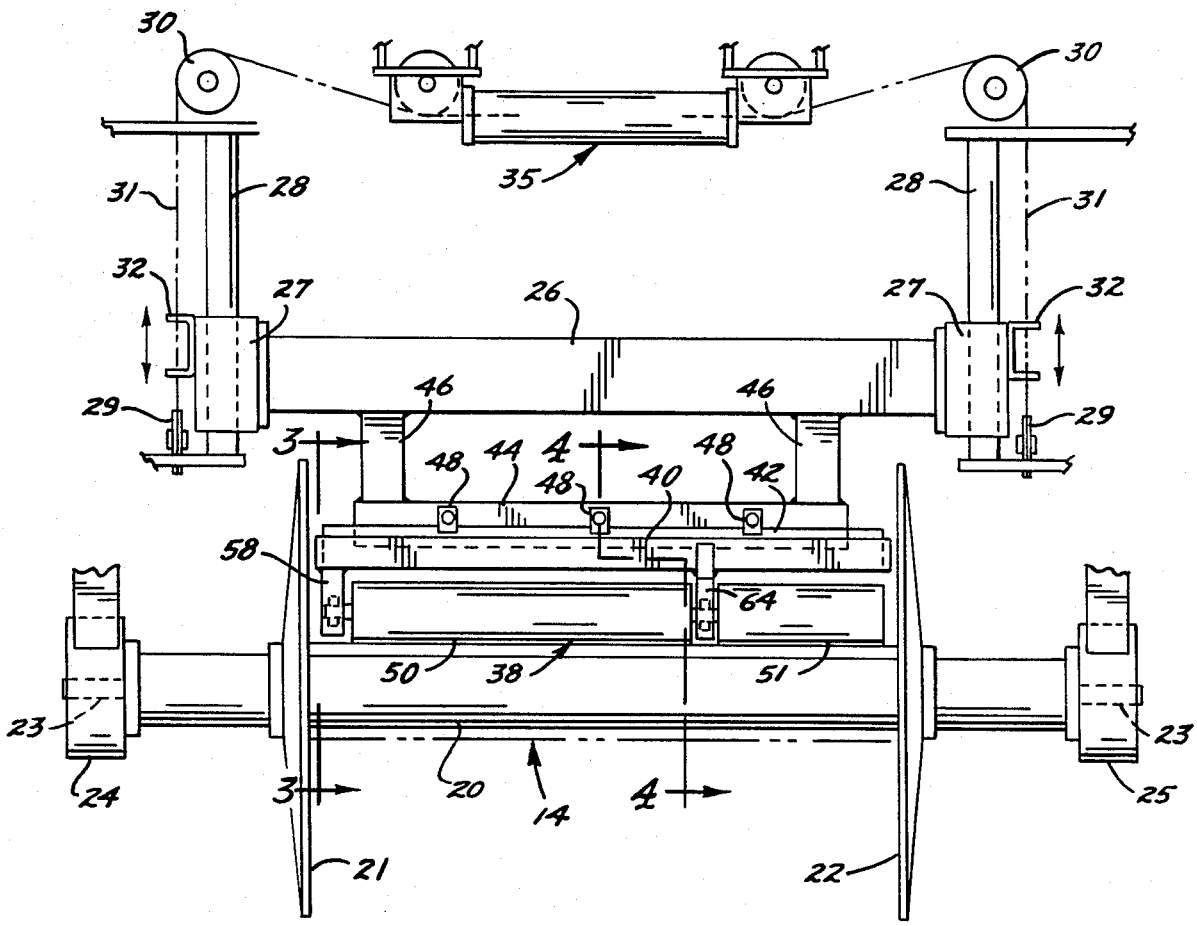
FIG. 2 is an enlarged top plan view of portions of the warper shown in FIG. 1 as taken along the line 2—2 of FIG. 1.

The beam 14 is shown most clearly in FIG. 2 and comprises a center mandrel 20 upon which the strands 11 are wound. Projecting radially outwardly from the end portions of the mandrel are axially spaced end flanges 21 and 22 which captivate the strands axially on the mandrel. Reduced diameter trunnions 23 extend axially from the ends of the mandrel and are adapted to be gripped by supporting means in the form of axially spaced collets 24 and 25. The collets are power-rotated in a conventional manner and serve to rotate the beam to cause the strands to be wound on the mandrel. The collets may be unclamped from the trunnions 23 and then retracted axially away from one another to enable a full beam to be removed from the warper 10 and replaced with an empty beam. The same warper is capable of handling beams 14 of different lengths, for example, beams ranging from 50" to 72" in length.

Figure 3:
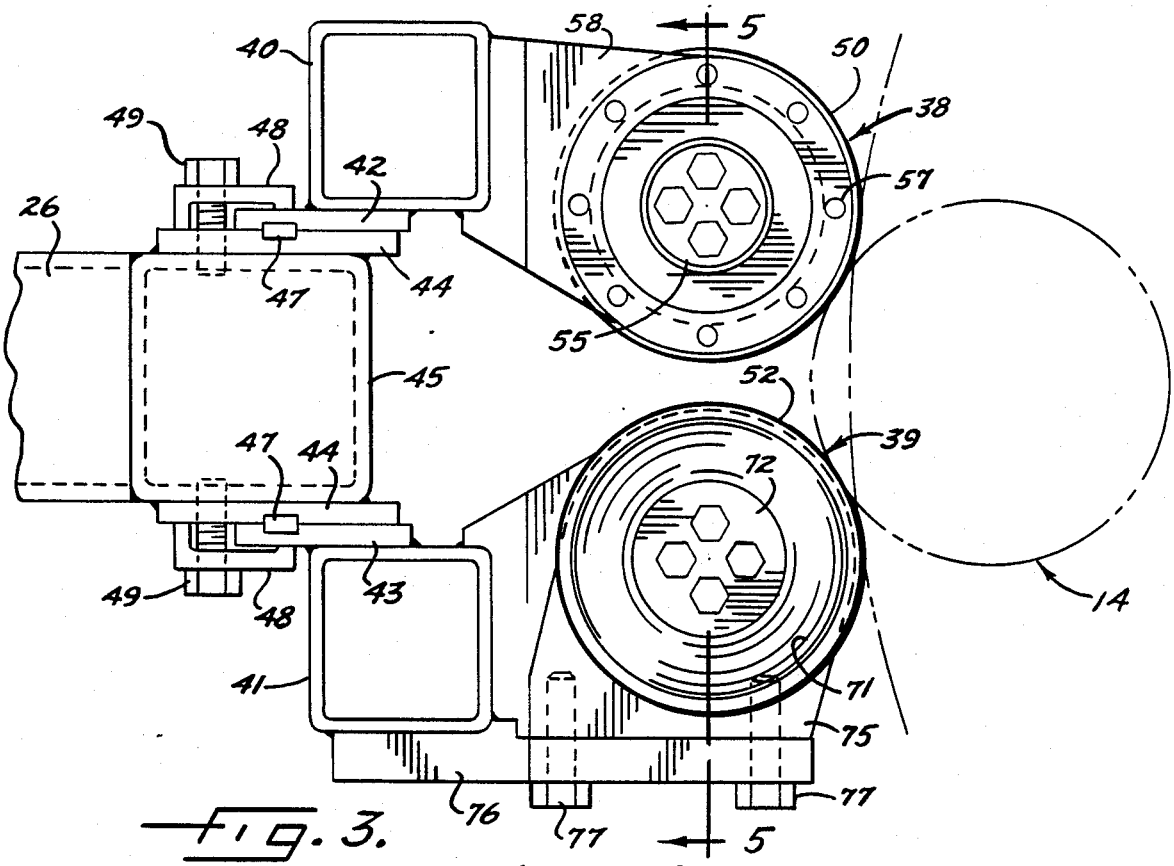
FIGS. 3 and 4 are enlarged fragmentary cross-sections taken substantially along the lines 3—3 and 4—4, respectively, of FIG. 2.
Figure 4:
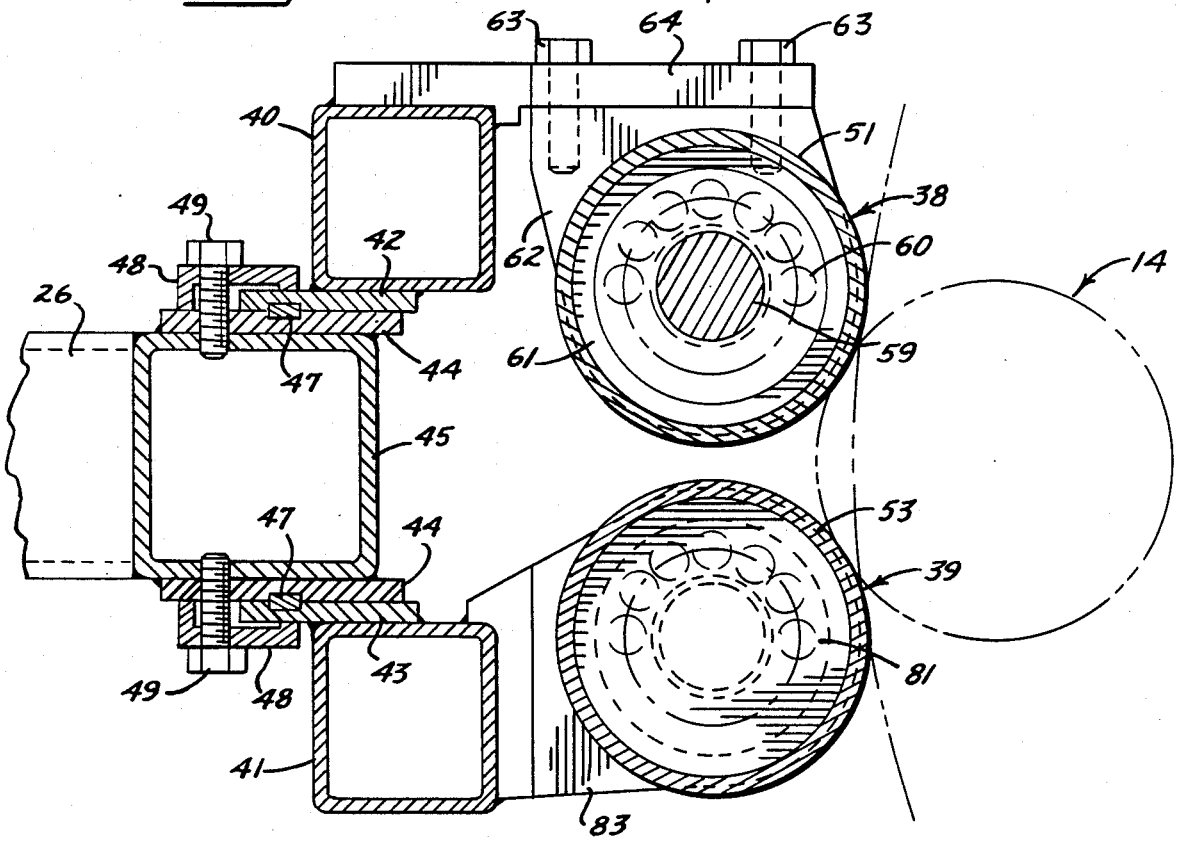

Located adjacent the rear side of the beam 14 are ironing roller means which act to press against the strands 11 as they are wound on the mandrel 20. The ironing roll means are supported by a tubular cross beam 26 (FIGS. 2 to 4) having fore-and-aft extending guide sleeve 27 (FIG. 2) at its ends. The guide sleeves are telescoped slidably onto elongated rods 28 which are fixed to the frame of the warper 10. Two vertically spaced pulleys 29 located in a common vertical plane are disposed adjacent the forward end of each rod while two vertically spaced pulleys 30 which are disposed in horizontal planes are located adjacent the rear end of each rod.

Extending around each pair of pulleys 29 and 30 of each rod 28 is a flexible cable 31 having one end anchored to a bracket 32 which is fixed to the adjacent sleeve 27. The other end of each cable is connected to an air cylinder mechanism 35 which pulls on the cables. As is apparent from FIG. 2, the mechanism 35 acts through the cables 31, the brackets 32, the sleeves 27 and the cross beam 26 to urge the roller means forwardly into pressing engagement with the strands 11 on the mandrel 20. As the pack of strands increases in diameter, the mechanism 35 yields to enable the ironing roller means to move radially outwardly from the mandrel.

In accordance with the present invention, the ironing roller means are defined by two parallel rollers 38 and 39 which are ruggedly supported and which may be easily adjusted to accommodate beams 14 of different lengths while still pressing against all of the threads 11 on the beam. By virtue of the adjustable ironing rollers 38 and 39, there is no need to replace an ironing roller with a roller of different length each time a beam of different length is installed in the warper 10.

More specifically, the ironing rollers 38 and 39 are located in vertically spaced relation at the rear of the beam 14 and are disposed tangent to the threads 11 on the beam. The rollers 38 and 39 are supported cantilever fashion from tubular beams 40 and 41 (FIG. 3), respectively. Plates 42 and 43 are welded to the lower side of the beam 40 and to the upper side of the beam 41, respectively, and are positioned to slide along plates 44 which are welded to the upper and lower sides of a tubular cross beam 45, the beam 45 being connected to the rear beam 26 by struts 46 (FIG. 2). Keys 47 (FIG. 3) guide the plates 42 and 43 for longitudinal sliding along the plates 44 when clamps 48 are released. When the clamps are tightened by screws 49, the plates 42 and 43 are locked against sliding relative to the plates 44.

Pursuant to the invention, the upper ironing roller 38 is formed by a long left-hand section 50 (FIG. 5) and by a shorter right-hand section 51 while the lower ironing roller 39 is defined by a short left-hand section 52 and by a longer right-hand section 53. As shown most clearly in FIG. 5, the left end of the left roller section 50 of the upper roller 38 includes a reduced-diameter trunnion 55 which is rotatably journaled by a ball bearing 56. The latter is supported within a bearing housing 57 which, in turn, is supported by a bracket 58 (FIG. 3) welded to and cantilevered from the beam 40. The right end of the left section 50 of the upper roller 38 includes a reduced diameter trunnion 59 (FIG. 5) which is journaled by a ball bearing 60 supported in a housing 61. A bracket 62 (FIG. 4) is fastened by screws 63 to a mounting arm 64 and supports the bearing housing 61, the mounting arm being welded to and extending cantilever fashion from the tubular beam 40.

The right-hand section 51 of the upper roller 38 is significantly shorter than the left-hand section 50 and its left end includes a hub 66 (FIG. 5) which receives the trunnion 59. A plate 67 clamps the hub 66 to the trunnion 59 and thus causes the right-hand section 51 of the roller 38 to rotate in unison with the left-hand section 50. The extreme right end of the right-hand section 51 is unsupported and thus the right-hand section extends cantilever fashion from the trunnion 59.

The lower ironing roller 39 is identical to the roller 38 but is turned end-for-end with respect thereto. Thus, the lower roller 39 includes a short left-hand section 52 having an unsupported left end and extending cantilever fashion from a trunnion 70 at the left end of the right-hand section 53 of the lower roller. A hub 71 within the right hand end portion of the left-hand section 52 is secured to the trunnion 70 by a clamping plate 72.

A ball bearing 73 (FIG. 5) rotatably supports the trunnion 70 of the right-hand roller section 53 and is supported by a housing 74 attached to a bracket 75 (FIG. 3) which, in turn, is secured to a mounting arm 76 by screws 77. The mounting arm 76 is welded to and extends forwardly from the lower side of the lower tubular beam 41.

The right-hand end of the right roller section 53 of the lower roller 39 includes a trunnion 80 (FIG. 5) rotatably supported by a bearing 81 within a housing 82. A bracket 83 (FIG. 4) welded to the lower beam 41 supports the bearing housing 82.

Figure 5:
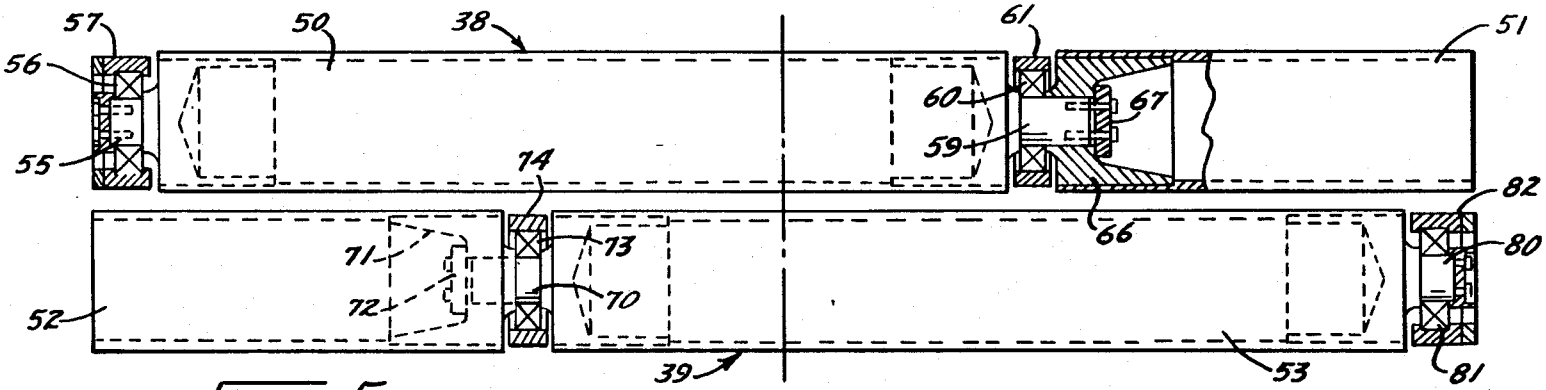
FIG. 5 is a cross-section taken substantially along the line 5—5 of FIG. 3.

It will be noted from FIG. 5 that the bearing housings 57, 61, 74 and 82 are located radially inwardly from the peripheral surfaces of the roller sections 50, 51, 52 and 53. Thus, the bearing housings do not interfere with the ability of the roller sections to contact the strands 11 on the beam 14.

Figure 6:
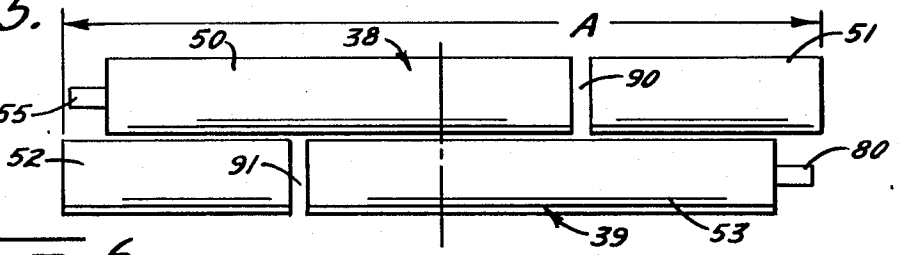
FIG. 6 is a schematic view showing the ironing rolls set up for use with the shortest beam adapted to be handled by the warper.

With the foregoing arrangement, the rollers 38 and 39 may be set up as shown in FIGS. 5 and 6 which a beam 14 of minimum length is installed in the warper 10. As is apparent from the FIG. 6, the left trunnion 55 of the left roller section 50 of the upper roller 38 is overlapped by the left roller section 52 of the lower roller 39 and its extreme left end is located in the same radial plane as the extreme left end of the left section 52. In addition, the trunnion 80 of the right roller section 53 of the lower roller 39 is overlapped by the right roller section 51 of the upper roller 38 and is located with its extreme right end in the same radial plane as the extreme right end of the right roller section 51.

With the rollers 38 and 39 set up as shown in FIG. 6, the distance A between the extreme left end of the left section 52 of the lower roller 39 and the extreme right end of the right section 51 of the upper roller 38 is just slightly greater than the length of a single roller and is just very slightly less than the axial spacing between the end flanges 21, 22 of the shortest beam 14 adapted to be handled by the warper 10. As is apparent from FIG. 6, each thread 11 along the dimension A is pressed by at least one roller 38 and 39, although most threads are pressed by both rollers. The only threads not pressed by both rollers are those at the extreme left and right end portions of the roller set and those located in the gap 90 (FIG. 6) between the roller sections 50 and 51 and the gap 91 between the roller sections 52 and 53. The gaps 90 and 91 are staggered axially relative to one another and accommodate the bearing housings 61 and 74, respectively.

Because no bearings are located at the right end portion of the right roller section 51 of the upper roller 38 or at the left end portion of the left roller section 52 of the lower roller 39, the right and left end portions of the rollers 38 and 39, respectively, may engage threads 11 located immediately adjacent the flanges 22 of the beam 14. At the same time, however, the long roller section 50 is ruggedly supported at both of its ends by the bearings 56 and 60, the long roller section 53 is ruggedly supported at both of its ends by the bearings 73 and 81, and the two short roller sections 51, 52 are each supported at one end by a bearing 60, 73. Although the opposite ends of the short sections 51 and 52 are not directly supported, this is of little consequence due to the relatively short length of the sections 51 and 52.

Figure 7:
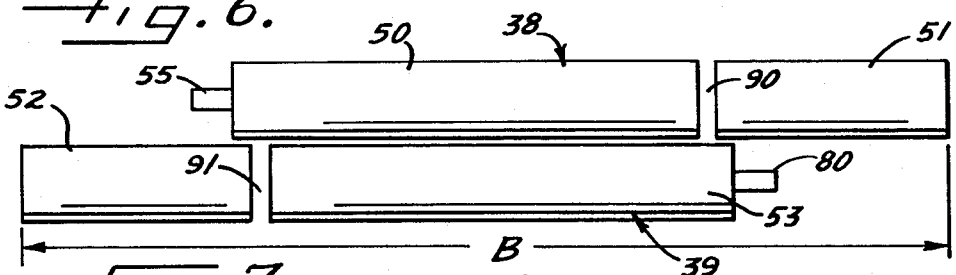
FIG. 7 is a view similar to FIG. 6 but shows the ironing rolls adjusted for use with a longer beam.

The roller set up shown in FIG. 7 is employed when the warper 10 is used with a beam 14 of maximum length B having a right end flange 22 which, when the long beam is fully installed, occupies the same position previously occupied by the right end flange of the shorter beam. To achieve the set up of FIG. 7, the lower clamps 48 are released and the plate 43 is slid to the left along the plate 44 until the sections 52 and 53 of the lower roller 39 are positioned as shown in FIG. 7 with respect to the sections 50 and 51 of the upper roller 39. As is apparent from FIG. 7, the roller section 53 spans the gap 90 between the roller sections 50 and 51 while the roller section 50 spans the gap 91 between the roller sections 52 and 53. Accordingly, each thread 11 is pressed by at least one roller surface and, the previously described rugged mounting of the rollers is not detrimentally affected when the lower roller 39 is adjusted.

Figure 8:
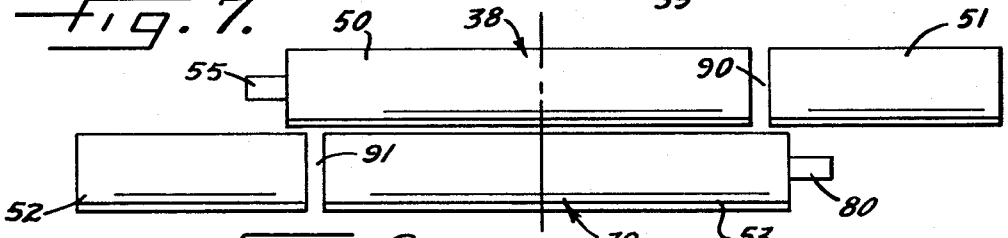
FIG. 8 also is a schematic view but shows the ironing rolls having been adjusted in a somewhat different fashion.

In the above description of the invention, it has been assumed that the right hand end flange 22 of the beam 14 is always returned to the same position regardless of the length of the beam. Under such circumstances, there is no need to adjust the position of the upper roller 38. If, however, both the left and right collets 24 and 25 are returned to positions keeping the axial center point of all beams at a common datum, the upper roller 38 also may be adjusted through a distance equal to the adjustment of the lower roller 39 but in a direction opposite thereto. The result of such adjustments is shown in FIG. 8.

From the foregoing, it will be apparent that the present invention brings to the art a new and improved warper 10 with ironing rolls 38 and 39 which may be easily adjusted to accommodate beams of different widths. Thus, the invention eliminates the need for replacing an ironing roll each time a beam of different length is installed in the warper. By virtue of the long and short roller sections, the rollers are supported in a rugged manner even though the outboard ends of the short sections are unsupported to allow those ends to be positioned closely adjacent the beam flanges 21, 22.

I claim:

1. A textile machine having an elongated beam, rotatable about a predetermined axis and operable when rotated to wind strands delivered to the beam from a supply, said beam comprising a winding mandrel and further comprising a pair of axially spaced end flanges extending radially outwardly from the end portions of the mandrel, means located adjacent the ends of the beam for rotatably mounting the beam, said mounting means being adapted to support beams of different lengths having end flanges with different axial spacing, first and second ironing rollers extending parallel to said axis and located between said end flanges, said ironing rollers being engageable with the strands on said beam and acting to press against said strands, and means supporting at least one of said ironing rollers for adjustment back and forth along said axis thereby to enable said rollers to be relatively positioned in accordance with the axial spacing between the end flanges of said beam, said one roller being defined by a relatively long section and by a shorter section spaced axially from said long section, said supporting means including first and second bearings, said first bearing being located between adjacent ends of said long and short sections and supporting both sections for rotation, said second bearing being located adjacent the opposite end of said long section and supporting the latter for rotation, the opposite end of said short section being unsupported, said bearings being located radially inwardly of the peripheral surfaces of said roller sections, said ironing rollers axially overlapping one another in all adjusted positions of said one ironing roller thereby to insure pressing of the strands along the entire length of each beam.

2. A textile machine as defined in claim 1 in which said other roller also is defined by a relatively long section and by a shorter section spaced axially from said long section, additional means supporting the other of said rollers for adjustment back and forth along said axis independent of the adjustment of said one roller, said additional means including (A) a bearing located between adjacent ends of adjacent long and short sections of said other roller and supporting both sections for rotation, and (B) a bearing located adjacent the opposite end of said long section of said other roller and supporting such long section for rotation, the opposite end of the short section of said other roller being unsupported, said bearings of said other roller being located radially inwardly of the peripheral surfaces of said roller sections of said other roller.

3. A textile machine as defined in claim 2 in which the bearings of one roller are offset axially with respect to the bearings of the other roller.

4. A textile machine as defined in claim 1 further including means supporting the other of said ironing rollers for adjustment back and forth along said axis independent of the adjustment of said one ironing roller.

5. A textile machine having an elongated beam rotatable about a predetermined axis and operable when rotated to wind strands delivered to the beam from a supply, said beam comprising a winding mandrel and further comprising first and second axially spaced end flanges extending radially outwardly from the end portions of said mandrel, first and second means located outboard of said first and second end flanges, respectively, for rotatably mounting said beam, at least one of said mounting means being adjustable along said axis relative to the other mounting means to change the axial spacing between said mounting means and thereby enable said means to support beams of different lengths having differently spaced end flanges, first and second ironing rollers extending parallel to said axis and located between said end flanges, each of said rollers having a length not greater than the axial spacing between the flanges of the shortest beam adapted to be handled by said textile machine, the combined length of said rollers being not substantially less than the axial spacing between the flanges of the longest beam adapted to be handled by said textile machine, a bearing located between the ends of each roller and disposed radially inwardly of the periphery of the roller thereby to rotatably support the roller while enabling the periphery of the roller to engage the threads on said beam, the bearing of said first roller being spaced axially from the bearing of said second roller, supporting means connected to the bearing of at least one of said ironing rollers and supporting such ironing roller for adjustment back and forth along said axis thereby to enable said ironing rollers to be positioned in accordance with the spacing between the end flanges of the beam being handled by the textile machine, said ironing rollers axially overlapping one another in all adjusted positions of said one roller thereby to insure pressing of the strands along the entire length of each beam.

6. A textile machine as defined in claim 5 further including bearings supporting non-adjacent ends of said first and second rollers, disposed radially inwardly of the peripheries of said rollers and connected to said supporting means, the opposite end of each roller being unsupported.

7. A textile machine having an elongated beam rotatable about a predetermined axis and operable when rotated to wind strands delivered to the beam from a supply, said beam comprising a winding mandrel and further comprising first and second axially spaced end flanges extending radially outwardly from the end portions of said mandrel, first and second means located outboard of said first and second end flanges, respectively, for rotatably supporting said beam, at least one of said supporting means being adjustable along said axis relative to the other of said supporting means to change the axial spacing between said supporting means and thereby enable said means to support beams of different lengths having differently spaced end flanges, first and second ironing rollers extending parallel to said axis and located between said end flanges, each of said rollers having a length not greater than the axial spacing between the flanges of the shortest beam adapted to be handled by said textile machine, the combined length of said rollers being not substantially less than the axial spacing between the flanges of the longest beam adapted to be handled by said textile machine, bearings located adjacent the left end of said first roller and adjacent the right end of said second roller, an additional bearing located between the ends of said first roller and being positioned nearer to the right end thereof than to the left end thereof, another additional bearing located between the ends of said second roller and being positioned nearer to the left end thereof than to the right end thereof, said bearings being located inwardly of the periphery of the associated roller thereby to rotatably support the roller while enabling the periphery of the roller to engage the threads on said beam, and means connected to said bearings and supporting said ironing rollers for independent adjustment back and forth along said axis thereby to enable said ironing rollers to be adjusted in accordance with the spacing between the end flanges of the beam being handled by the textile machine, said ironing rollers axially overlapping one another in all adjusted positions of said rollers thereby to insure pressing of the strands along the entire length of each beam.

* * * * *